US011598032B2

(12) United States Patent
Fujita et al.

(10) Patent No.: US 11,598,032 B2
(45) Date of Patent: Mar. 7, 2023

(54) WEB SUPPORT, PRODUCTION METHOD THEREFOR, AND PATTERNING METHOD

(71) Applicant: Nippon Filcon Co., Ltd., Tokyo (JP)

(72) Inventors: Naoki Fujita, Tokyo (JP); Megumi Taguchi, Tokyo (JP); Takehiko Tatsuno, Tokyo (JP); Masahiro Yoshikawa, Tokyo (JP)

(73) Assignee: NIPPON FILCON CO., LTD., Tokyo (JP)

( * ) Notice: Subject to any disclaimer, the term of this patent is extended or adjusted under 35 U.S.C. 154(b) by 103 days.

(21) Appl. No.: 16/769,169

(22) PCT Filed: Oct. 11, 2018

(86) PCT No.: PCT/JP2018/037837
§ 371 (c)(1),
(2) Date: Jun. 2, 2020

(87) PCT Pub. No.: WO2019/142412
PCT Pub. Date: Jul. 25, 2019

(65) Prior Publication Data

US 2021/0214869 A1 Jul. 15, 2021

(30) Foreign Application Priority Data

Jan. 16, 2018 (JP) ..... JP2018-005237

(51) Int. Cl.
*C23F 1/14* (2006.01)
*D04H 1/495* (2012.01)
*D06B 23/04* (2006.01)

(52) U.S. Cl.
CPC ..... *D04H 1/495* (2013.01); *C23F 1/14* (2013.01); *D06B 23/04* (2013.01)

(58) Field of Classification Search
None
See application file for complete search history.

(56) References Cited

U.S. PATENT DOCUMENTS 3,616,341 A * 10/1971 Jumer ..... C23F 3/00 216/91
3,679,500 A * 7/1972 Kubo et al. ..... H01J 29/81 216/56

(Continued)

FOREIGN PATENT DOCUMENTS

JP S62125058 6/1987
JP H04343748 11/1992

(Continued)

OTHER PUBLICATIONS

International Search Report for corresponding International Application No. PCT/JP2018/037837, dated Jan. 15, 2019; 2 page.

*Primary Examiner* — Allan W. Olsen
(74) *Attorney, Agent, or Firm* — Fattibene and Fattibene, LLC; Paul A. Fattibene

(57) ABSTRACT

A web support with a high degree of patterning freedom and excellent durability, a production method therefor, and a patterning method. The web support is used when applying a pattern to a nonwoven substance by jetting a high-pressure water stream on a web. The web support production method comprises: a step of preparing a flat metal base material; a step for forming, by etching, a first water conduction hole and second water conduction hole that pass through the front surface of the base material to the back surface, and a recess on the front surface of the base material that includes the first water conduction hole and that corresponds to the pattern; and a step for forming the base material into a cylindrical main body section by welding the edges of the base material to each other.

4 Claims, 4 Drawing Sheets

(56) References Cited

U.S. PATENT DOCUMENTS

| | | | | |
|---|---|---|---|---|
| 3,934,503 | A * | 1/1976 | Kinney | B41N 1/245 101/128.21 |
| 4,868,958 | A | 9/1989 | Suzuki et al. | 28/104 |
| 5,098,764 | A * | 3/1992 | Bassett | D04H 1/495 428/131 |
| 5,674,591 | A * | 10/1997 | James | D04H 1/495 428/156 |
| 9,205,639 | B2 * | 12/2015 | Wefers | B41F 15/34 |
| 2003/0134560 | A1 | 7/2003 | Bevan | 422/408 |
| 2004/0126601 | A1 | 7/2004 | Kramer et al. | 428/480 |
| 2005/0064143 | A1 | 3/2005 | Bevan | 428/151 |
| 2008/0028581 | A1 * | 2/2008 | Ronzani | D04H 18/04 28/104 |
| 2011/0094398 | A1 * | 4/2011 | Wefers | B41N 1/24 101/128.4 |

FOREIGN PATENT DOCUMENTS

| | | | |
|---|---|---|---|
| JP | H08100360 | | 4/1996 |
| JP | 2003535989 | | 12/2003 |
| JP | 2005511908 | | 4/2005 |
| JP | 2005213685 | | 8/2005 |
| JP | 2006512490 | | 4/2006 |
| JP | 2007090752 | A * | 4/2007 |

* cited by examiner

WEB SUPPORT, PRODUCTION METHOD THEREFOR, AND PATTERNING METHOD

TECHNICAL FIELD

The present invention relates to a web support used when manufacturing a nonwoven substance such as nonwoven cloth, fancy paper, wall paper, a wet wipe, or a building material by a spunlace method (water stream entangling method) and applying a pattern to the nonwoven substance, a manufacturing method therefor, and a patterning method.

BACKGROUND ART

A spunlace method that a high-pressure water stream onto a web obtained by laminating fibers and spreading the fibers into a sheet to manufacture a nonwoven substance such as nonwoven cloth or paper has been conventionally known. An uneven pattern may be applied to a nonwoven substance to improve the texture of the nonwoven substance or to obtain the tenderness of the nonwoven substance, or holes in which fibers are not present may be formed in the plane of the nonwoven cloth to absorb and remove dust, stain, or the like. In such a case, a mark welded on a wire in accordance with a pattern, a resin formed into a pattern shape corresponding to a pattern by printing or UV hardening (for example, see Patent Literature 1), or fabric for patterning, or the like is used (for example, see Patent Literature 2).

CONVENTIONAL ART LITERATURE

Patent Literature

Patent Literature 1 Japanese Patent No. 4744151
Patent Literature 2 Japanese Patent No. 4266841

SUMMARY OF THE INVENTION

Problem to be Solved by the Invention

However, when a pattern is to be applied by using a mark welded on a wire in accordance with the pattern, the mark is hard to be welded, and the welded mark may remove disadvantageously. In addition, when a pattern is applied by using a resin formed into a pattern shape corresponding to the pattern, the patterning freedom is high, but the resin may remove disadvantageously when a high-pressure water stream is repeatedly jetted.

When a pattern is applied by using fabric for patterning, since the pattern is limited to a geometrical pattern such as a grating or a houndstooth check, the patterning freedom is disadvantageously low.

Thus, technical problems to be solved to provide a web support having high patterning freedom and excellent durability, a manufacturing method therefor, and a patterning method have been posed, and the present invention has as its object to solve the problems.

Means for Solving the Problem

In order to achieve the object, a web support according to the present invention is a web support used when applying a pattern to a nonwoven substance by jetting a high-pressure water stream on a web and including a metal main body section formed in a cylindrical shape, a recess and a convexity formed on a front surface of the main body section in accordance with the pattern, and a water conduction hole formed to pass through the recess and the convexity to a back surface of the main body section.

According to the configuration, since the recess and the convexity are formed together with the main body section, the recess and the convexity can be avoided from dropping and removing. In addition, the metal main body section has excellent durability, is strong to extension, deformation, and abrasion, and can be used for a long period of time. Furthermore, the recess and the convexity formed on the front surface of the main body section can be freely set in accordance with the shape of a pattern, and can correspond to various patterns. Note that the patterns include an uneven surface applied to a nonwoven substance and voids (holes) in the nonwoven substance.

Furthermore, in the web support according to the present invention, the main body section can preferably cover a roll supporting the main body section and having water permeability.

According to the configuration, a plurality of web supports having different patterns are prepared, the web supports are replaced with each other depending on a pattern to be applied to a nonwoven substance to make it possible to cope with the various patterns.

A method of manufacturing a web support according to the present invention is a method of manufacturing a web support used when applying a pattern to a nonwoven substance by jetting a high-pressure water stream on a web and including a step of preparing a flat metal base material, a step for forming, by etching, a recess and a convexity corresponding to the pattern on a front surface of the base material and a water conduction hole that passes through the recess and the convexity and a back surface of the base material, and a step for forming the base material in a cylindrical main body section. Note that the pattern includes an uneven surface applied to a nonwoven substance or voids (holes) in the nonwoven substance.

According to the configuration, the recess, the convexity, and the water conduction hole are formed on the base material surface by etching, and the web support can be formed in a cylindrical shape by only welding edges of the base material to each other, so that the web support can be efficiently manufactured.

Since the recess and the convexity are integrally formed on the main body section, the recess and the convexity can be avoided from dropping or removing. In addition, the metal main body section has excellent durability, is strong to extension, deformation, and abrasion, and can be used for a long period of time. Since the recess and the convexity formed on the front surface of the main body section can be freely set depending on the shape of a pattern, the web support can cope with various patterns.

In the method of manufacturing a web support, in the step for performing etching, after the water conduction hole is formed to pass through the front surface of the base material to the back surface, the recess is preferably formed by half-etching.

According to the configuration, the water conduction hole, the recess, and the convexity can be accurately formed at desired positions. Patterns to be applied to a web can be changed depending on the strong and weak of unevenness.

The method of manufacturing a web support according to the present invention preferably includes the step of electropolishing the base material before the step for forming the base material in a cylindrical shape.

According to the configuration, since the corner of the recess and the water conduction hole are formed into a moderately curved shape by the electropolishing, the nonwoven substance becomes good in peelability, and the nonwoven substance can be easily released from the web support.

The patterning method according to the present invention patterns a nonwoven substance by using the web support or a web support manufactured by the manufacturing method.

According to the configuration, since the recess and the convexity are formed together with the web support, the recess and the convexity can be avoided from dropping, removing, or the like. The metal web support has excellent durability, is strong to extension, deformation, and abrasion, and can be used for a long period of time. Since the recess and the convexity formed on the front surface of the main body section can be freely set depending on the shape of a pattern, the web support can cope with various patterns.

Advantages

In the present invention, since the recess and the convexity are formed together with the main body section, the recess and the convexity can be avoided from dropping, removing, or the like. The metal web support has excellent durability, is strong to extension, deformation, and abrasion, and can be used for a long period of time. Since the recess and the convexity formed on the front surface of the main body section can be freely set depending on the shape of a pattern, the web support can cope with various patterns.

MODES FOR CARRYING OUT THE INVENTION

An embodiment of the present invention will be described below with reference to the accompanying drawings. In the following description, when the numbers, numerical values, quantities, ranges, and the like of constituent elements are mentioned, unless otherwise specified or except that the numbers are limited to theoretically clear numbers, the numbers are not specific numbers and may be larger or less than the specific numbers. In addition, the steps configuring the embodiment, unless otherwise specified and except in the obvious case, a sequential order is not limited to the following order, and the plurality of steps may be executed in parallel with each other.

A web support according to the present invention can be applied to a manufacturing device for a nonwoven substance such as nonwoven cloth or paper. The nonwoven substance includes nonwoven cloth, fancy paper, wall paper, a wet wipe, or a building material. In the embodiment, an example in which a web support 10 is applied to a nonwoven cloth manufacturing device 1 that manufactures nonwoven cloth having a convex pattern by using a spunlace method is described. The pattern to be mentioned includes an uneven surface applied to a nonwoven substance or voids (holes) in the nonwoven substance.

Figure 1:
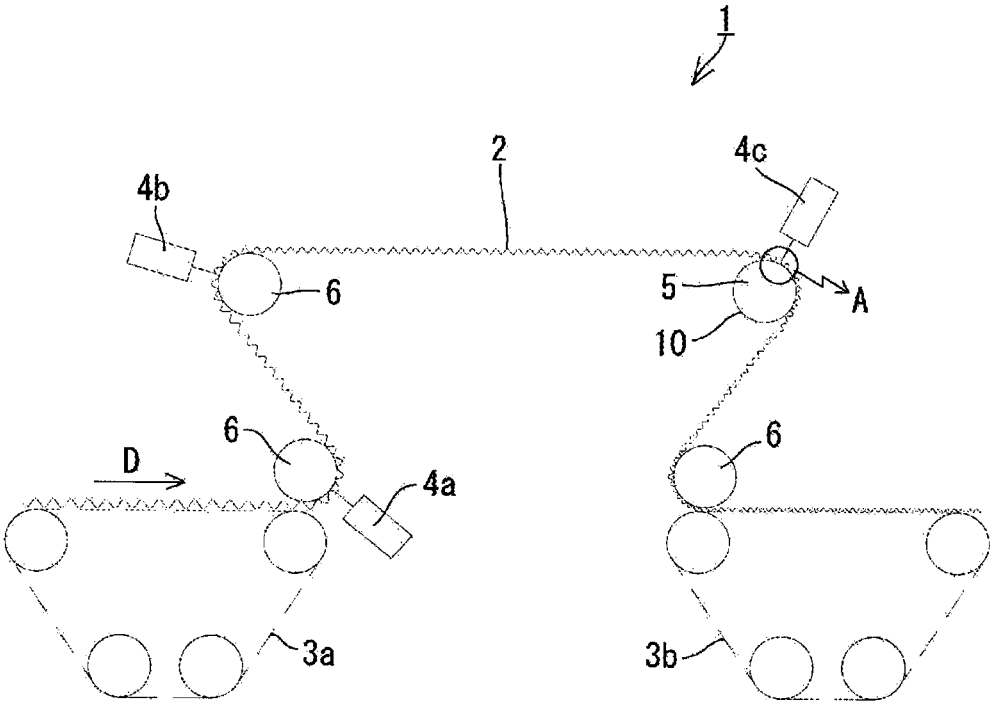
FIG. 1 is a pattern diagram showing a web patterning device to which a web support according to an embodiment of the present invention is applied.

FIG. 1 is a pattern diagram showing a configuration of the nonwoven cloth manufacturing device 1 to which the web support 10 is applied. The nonwoven cloth manufacturing device 1 includes mesh belts 3*a* and 3*b*, three water jets 4*a*, 4*b*, and 4*c*, a first roll 5 covered with the web support 10, and a second roll 6 guiding a web 2 in a conveyance direction D.

The water jets 4*a*, 4*b*, and 4*c* are arranged along a conveyance direction D of the web 2. The water jets 4*a* and 4*b* are arranged one by one above the second roll 6 to face the second roll 6. The water jets 4*a* and 4*b* jet high-pressure water streams toward the web 2 conveyed along the outer periphery of the second roll 6. The number of the arranged water jets 4*a* and 4*b* facing one second roll 6 are not limited to a specific number, and the number may be one or two or more. In addition, the water jets 4*a* and 4*b* are not limited to water jets arranged above the second roll 6, and, for example, the water jets may be arranged in a lateral direction vertical to the second roll 6.

The water jet 4*c* is arranged as one water jet above the first roll 5 to face the first roll 5. The water jet 4*c* jets a high-pressure water stream toward the web 2 conveyed along the outer periphery of the first roll 5. The water jet 4*c* applies a pattern to the web 2. The number of arranged water jets 4*c* for one roll 5 is not limited to a specific number, and the number may be one or two or more. In addition, the water jet 4*c* is not limited to a water jet arranged above the first roll 5, and, for example, the water jet may be arranged in a lateral direction vertical to the first roll 5.

The first roll 5 is covered with the web support 10. The first roll 5 and the second roll 6 have water permeability.

In this manner, the web has an orbit set to go along the outer periphery of the web support 10 covering the first roll 5 and the outer periphery of the second roll 6.

The mesh belt 3*a* conveys the web 2 the first-order second roll 6 in the conveyance direction D of the web 2. The web 2 is peeled from the mesh belt 3*a* before the web 2 receives a high-pressure water stream from the water jet 4*a*, and is independently conveyed without passing through the mesh belt 3*a*.

The mesh belt 3*b* receives the web 2 to which a pattern is applied from the second roll 6. The nonwoven cloth manufacturing device 1 is not limited to a configuration in which the web 2 is conveyed to be in direct contact with the web support 10, and may have a configuration in which, for example, the web 2 is conveyed along the periphery of the web support 10 while passing through the mesh belt.

Figure 2:
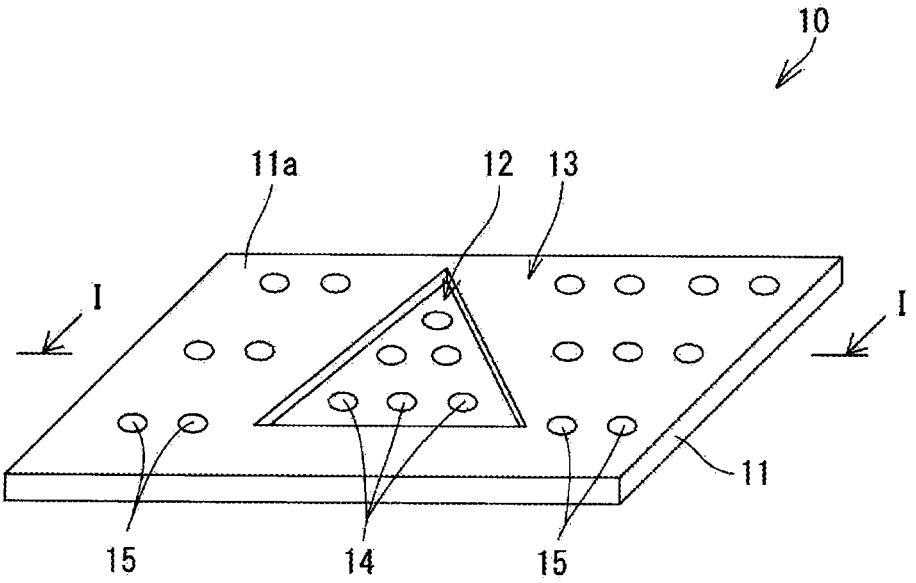
FIG. 2 is a perspective view showing a front surface of the web support when a pattern of nonwoven cloth is a recess.
Figure 3:
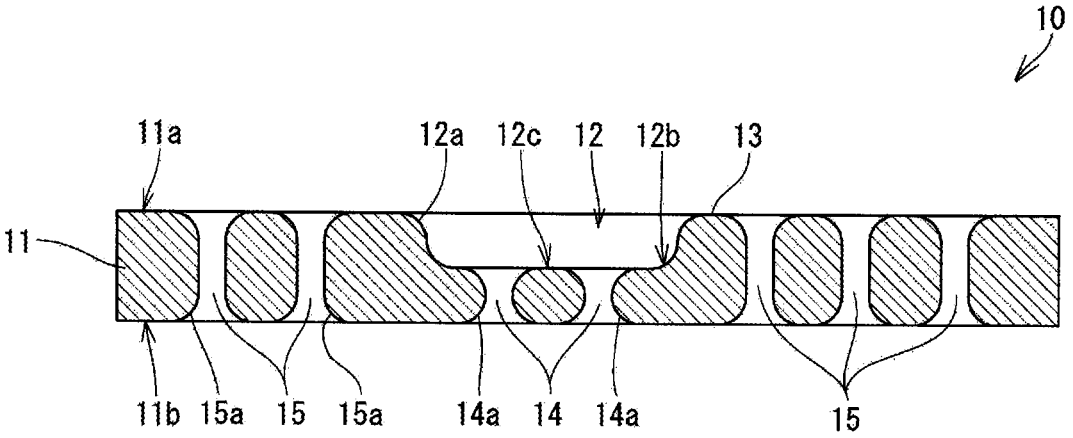
FIG. 3 is a sectional view of the web support along an I-I line in FIG. 2.

FIG. 2 is a perspective view showing the front surface of the web support 10 when a pattern on nonwoven cloth is expressed as a convexity. FIG. 3 is a longitudinal sectional view of the web support 10 along an I-I line in FIG. 2. As shown in FIGS. 2 and 3, in the web support 10, a cylindrical main body section 11, a recess 12, a convexity 13, a first water conduction hole 14, and a second water conduction hole 15 are formed.

The recess 12 is concavely formed on a front surface 11*a* of the main body section 11. The convexity 13 is convexly formed on the periphery of the recess 12. The recess 12 and the convexity 13 have shapes set depending on an uneven pattern applied to the web 2. The depth of the recess 12 is set to be almost half the thickness of the web support 10. The depth of the recess 12 may be arbitrarily changed depending on the strong and weak of the unevenness of the pattern applied to the web 2. The corners 12*a* and 12*b* of the recess 12 are formed in moderately curved shapes.

The first water conduction hole 14 is formed to penetrate the main body section from a bottom surface 12*c* of the recess 12 to a back surface 11*b* of the main body section 11. A corner 14*a* of the first water conduction hole 14 is formed in a moderately curved shape.

The second water conduction hole 15 is formed to penetrate the main body section 11 from the front surface 11*a* of the main body section 11 to the back surface 11*b*. A corner 15*a* of the second water conduction hole 15 is formed in a moderately curved shape.

Figure 4:
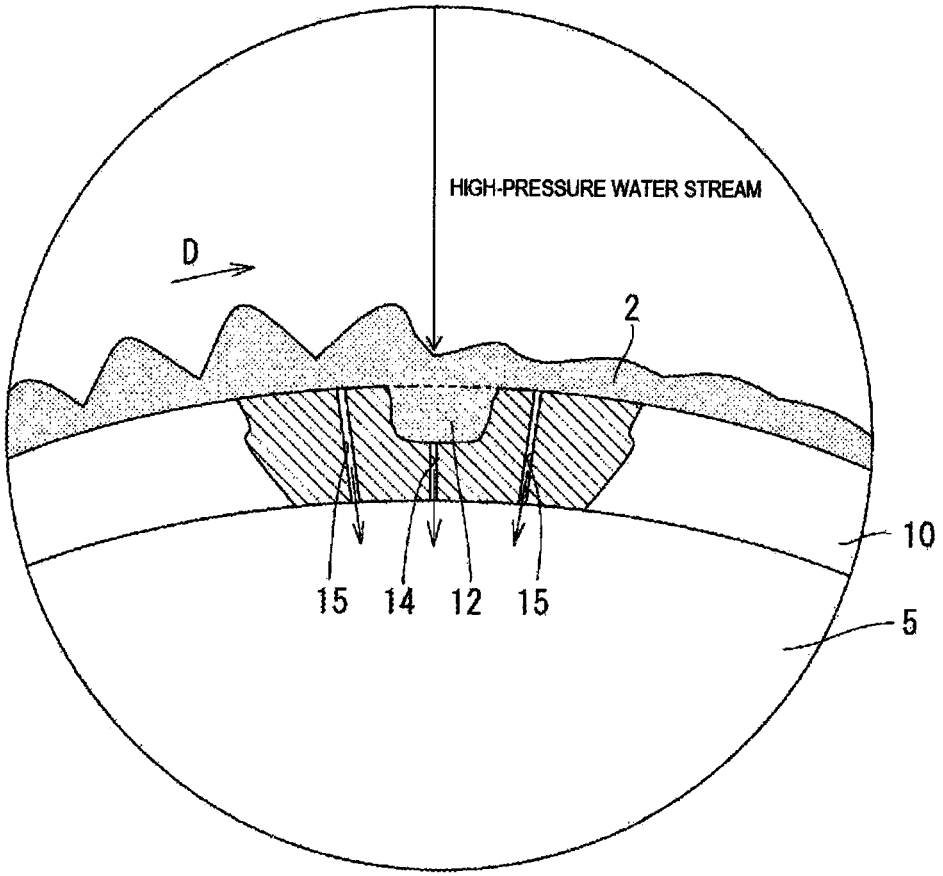
FIG. 4 is a partially cutaway enlarged view showing an A part in FIG. 1.

An operation of the nonwoven cloth manufacturing device 1 will be described below with reference to FIGS. 1 and 4. FIG. 4 is a partially cutaway enlarged view of an A part in FIG. 1.

Fibers serving as a material are laminated on the mesh belt 3*a* in an opened state obtained by a carding machine (not shown) to form the web 2. The fibers are continuously supplied onto the mesh belt 3*a*.

The mesh belt 3*a* conveys the web 2 along the outer periphery of the second roll 6 in the direction of an arrow D in FIG. 1. For example, a conveyance speed of the web 2 is set to 20 m/min or more. After the webs 2 are uniformly aligned on the mesh belt 3*a*, the water jet 4*a* supplies a pre-shower to the webs 2 to make the webs 2 wet, and the water jet 4*b* forms the webs 2 into the form of a sheet.

The webs 2 are conveyed to the lower side of the water jet 4*c*, fibers in the webs 2 are interlaced by a high-pressure water stream jetted from the water jet 4*c*. The water jets 4*a*, 4*b*, and 4*c* can be set to pressures different from each other, and, for example, 10 MPa or less. The pressures of the water jets 4*a*, 4*b*, and 4*c* are set to 5 MPa, 10 MPa, and 10 MPa in the order named. In addition, the water jets 4*a*, 4*b*, and 4*c* jet high-pressure water streams at a nozzle diameter # of 0.1 mm and a pitch of 1 mm. After the high-pressure water stream supplied from the water jet 4*c* penetrates the web 2, the high-pressure water stream penetrates the web support 10 through the first water conduction hole 14 and the second water conduction hole 15.

Furthermore, as shown in FIG. 4, the webs 2 conveyed to be in direct contact with the upper side of the web support 10 is pressed against the web support 10 by the high-pressure water stream. Since the webs 2 are compressed along the front surface shape of the web support 10, a part of the web 2 facing the recess 12 is formed into a convex shape.

The webs 2 passing through the first roll 5 and the second roll 6 are conveyed into a drying step (not shown) and then winded in the form of a roll. In the drying step, the webs 2 are dried by being exposed to hot air at, for example, 120° C. for 5 minutes.

A manufacturing method of the web support 10 will be described below. FIGS. 5*a* to 5*i* show steps in manufacturing the web support 10.

Figure 5A:
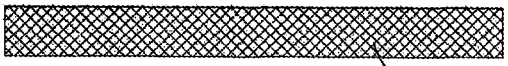
FIGS. 5*a* to 5*i* are pattern diagrams showing a manufacturing procedure of a web support.

As shown in FIG. 5*a*, a board-like base material 16 is prepared. The thickness of the base material 16 is set to, for example, 2 mm or less, and preferably set to 0.3 to 2 mm. The thickness of the base material 16 is set to 2 mm or less to make it possible to apply etching (will be described later) to the base material 16. In this embodiment, the thickness of the base material 16 is set to 1 mm. In addition, in the embodiment, as a raw material of the base material 16, SUS304 which is excellent in resistance in corrosion is employed. However, the raw material is not limited to SUS304.

Figure 5B:
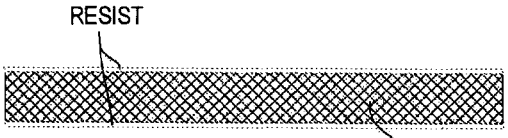
Figure 5C:
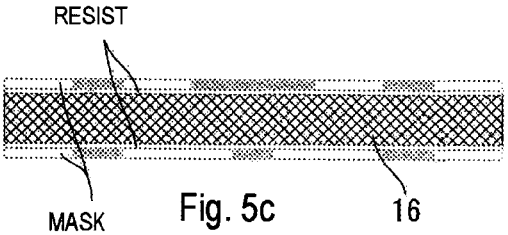
Figure 5D:
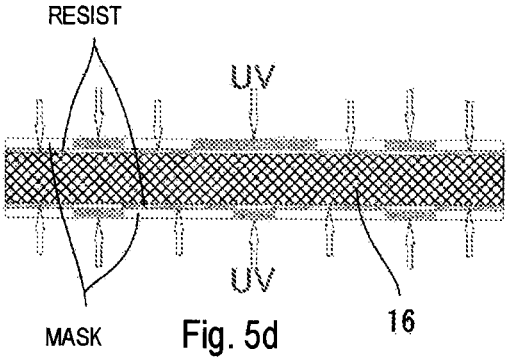
Figure 5E:
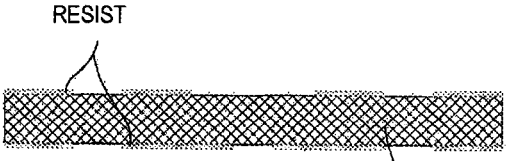
Figure 5F:
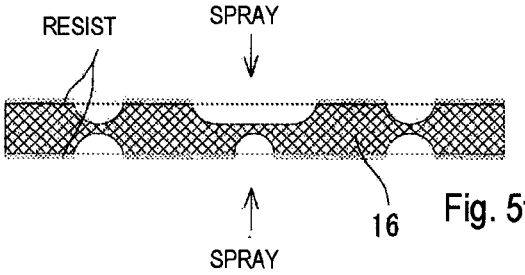
Figure 5G:
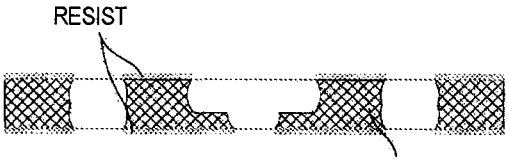
Figure 5H:
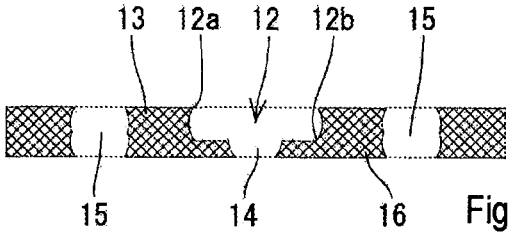

Antirust oil applied to the front surface of the base material 16 is removed by alkaline degreasing. As shown in FIG. 5*b*, a dry film resist of a first photosensitive resin is stuck on the front surface of the base material 16, or a liquid resist is applied thereto. Thereafter, as shown in FIGS. 5*c* to 5*e*, pattern exposure is performed by using a mask, and a nonexposed part is washed out. As shown in FIG. 5*f*, iron chloride liquid is sprayed onto the base material 16 to gradually remove an exposed part of the base material 16 from the front surface to the back surface of the base material 16, and, as shown in FIG. 5*g*, the exposed part of the base material 16 is removed to penetrate the base material 16 from the front surface to the back surface so as to collectively form a part of the recess 12, the first water conduction hole 14, and the second water conduction hole 15. As shown in FIG. 5*h*, the resist is peeled by a sodium hydroxide solution. Note that the recess 12 may be formed by half-etching after the first water conduction hole 14 and the second water conduction hole 15 are formed.

Figure 5I:
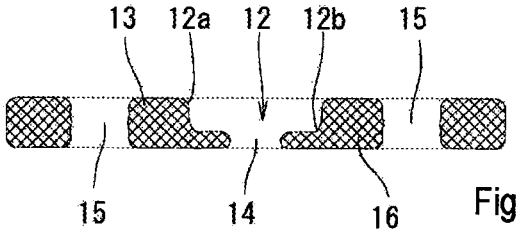

As shown in FIG. 5*i*, the corners 12*a* and 12*b* of the recess 12, the first water conduction hole 14, and the second water conduction hole 15 are formed in a moderately curved shape. The corners 12*a* and 12*b* of the recess 12 are formed in the moderately curved shape to improve the peelability, and the webs 2 can be easily released from the web support 10.

In the embodiment, the corners 12*a* and 12*b* of the recess 12, the first water conduction hole 14, and the second water conduction hole 15 are formed into a curved shape by using electropolishing. A procedure of electropolishing is a common procedure. For example, the base material 16 which is washed by acid is dipped in an electropolishing solution, and a pressure is applied across the base material 16 and the electropolishing solution for a predetermined period of time. As the electropolishing solution, salines such as sulfuric acid, phosphoric acid, nitric acid, perchloric acid, and hydrochloric acid are used. After the polishing, the electropolishing solution is washed away.

As a polishing method except for the electropolishing, chemical polishing or physical washing may be employed. The electropolishing is better than the chemical polishing in that the edge can be removed more cleanly in the electropolishing than in the chemical polishing. The electropolishing is better than the physical polishing in that distortion or the like does not occur in the base material 16 because contactless polishing can be performed to the base material 16.

Thereafter, the base material is transformed into a cylindrical shape, and the ends of the base material 16 are joined to each other by laser welding to obtain the cylindrical web support 10. Depending on the size of the web support 10, the ends of the plurality of base materials 16 may be welded to each other to transform the welded base materials 16 into a cylindrical shape. The laser welding has the following advantages in comparison with other welding methods. That is, since the laser welding has a narrow beat width, a large welding depth, and small welding marks, the recess 12 can be arranged over a large area on the front surface of the base material 16, total heat to the base material 16 can be reduced, so that the base material 16 is not easily distorted.

In this manner, in the web support 10 according to the embodiment, the recesses 12 can be collectively formed on the entire surface of the base material 16 by etching, and the main body section 11 can be formed in a cylindrical shape as long as the ends of the base material 16 on which the recess 12 is formed are welded to each other. For this reason, the web support 10 can be efficiently manufactured.

Since the recess 12 can be formed together with the main body section 11, an actual pattern corresponding to a pattern can be avoided from dropping, removing, or the like. Furthermore, since the shape of the recess 12 can be freely set, the recess 12 can cope with various patterns.

The metal web support 10 is strong to extension, deformation, and abrasion and can be used for a long period of time.

Furthermore, since the web support 10 can be formed to cover the first roll 5, a plurality of web supports 10 having different patterns are prepared, and the web supports 10 can be replaced with each other depending on a pattern to be applied to the web 2.

The various changes and modification of the present invention can be effected without departing from the spirit and scope of the invention, and the present invention includes the modifieds as a matter of course.

REFERENCE NUMERALS

1 nonwoven cloth manufacturing device
2 web
3*a*, 3*b* mesh belt
4*a*, 4*b*, 4*c* water jet
5 first roll
6 second roll
10 web support
11 main body section
11*a* front surface
11*b* back surface
12 recess
12*a*, 12*b* corner
12*c* bottom surface
13 convexity
14 first water conduction hole
14*a* corner (of first water conduction hole)
15 second water conduction hole
15*a* corner (of second water conduction hole)
16 base material

What is claimed is:

1. A method of manufacturing a web support used when applying a pattern to a nonwoven substance by jetting a high-pressure water stream on a web, comprising:

a step of preparing a flat metal base material having a back surface;

a step for forming collectively, by etching, a recess and a convexity corresponding to the pattern on a front surface of the base material and a water conduction hole that passes through the base material; and a step for forming the base material in a cylindrical main body section.

2. The method of manufacturing a web support according to claim 1, wherein, in the step for forming collectively, by etching, the recess is formed by etching to a depth of less than half a thickness of the base material.

3. The method of manufacturing a web support according to claim 1, further comprising a step of electropolishing the base material before the step for forming the base material in the cylindrical main body section.

4. A method of manufacturing a web support used when applying a pattern to a nonwoven substance by jetting a high-pressure water stream on a web, comprising the steps of:

forming a flat metal base material having a front and back surface;

placing a front resist pattern on the front surface and a back resist pattern on the back surface of the flat metal base material, the back resist pattern on the back surface comprising an opening in the back resist pattern over a back first water conduction through hole location and an opening over a back second water conduction through hole location and the front resist pattern on the front surface comprising an opening over a front recess location opposing the back first water conduction through hole location and an opening over a front second water conduction through hole location adjacent the front recess location and opposing the back second water conduction through hole location;

etching the flat metal base material on the front surface and the back surface so as to collectively form a recess at the front recess location, a first water conduction through hole at the back and front first water conduction through hole location, and a second water conduction through hole at the back and front second water conduction through hole location;

wherein the recess corresponds to the pattern to be applied to the nonwoven substance by jetting a high-pressure water stream on the web; and transforming the flat metal base material into a cylindrical shape.

* * * * *